US011548314B2

(12) United States Patent
Cai

(10) Patent No.: US 11,548,314 B2
(45) Date of Patent: Jan. 10, 2023

(54) TOY FOR PAINTING EGGS

(71) Applicant: Wenxi Cai, Shantou (CN)

(72) Inventor: Wenxi Cai, Shantou (CN)

( * ) Notice: Subject to any disclaimer, the term of this patent is extended or adjusted under 35 U.S.C. 154(b) by 0 days.

(21) Appl. No.: 17/696,851

(22) Filed: Mar. 16, 2022

(65) Prior Publication Data

US 2022/0203754 A1 Jun. 30, 2022

(30) Foreign Application Priority Data

Jan. 6, 2022 (CN) ..... 202220014386.1

(51) Int. Cl.
*B44D 2/00* (2006.01)
*B65D 85/28* (2006.01)

(52) U.S. Cl.
CPC ..... *B44D 2/002* (2013.01); *B65D 85/28* (2013.01)

(58) Field of Classification Search
CPC ..... B44D 2/002; B44D 2/007; B65D 85/28; B65D 85/20
USPC ..... 269/95; 118/13, 500, 503, 504, 505; 206/575, 579, 1.7, 1.8, 1.9; 446/146
See application file for complete search history.

(56) References Cited

U.S. PATENT DOCUMENTS 2,270,177 A * 1/1942 Vawryk ..... B44D 3/00 118/409
2,727,325 A * 12/1955 Jurinic ..... B44D 3/00 118/503
3,358,644 A * 12/1967 Greene ..... B05C 13/025 118/503
3,792,163 A * 2/1974 Fudro ..... B05C 9/08 33/21.4
3,848,564 A * 11/1974 Kull ..... B44D 3/00 33/18.1
5,063,871 A * 11/1991 Chambers ..... B44D 3/00 118/503
5,164,009 A * 11/1992 Chandler ..... B44D 3/00 118/503
11,044,976 B1 * 6/2021 Debro ..... A45C 13/02
11,235,348 B2 * 2/2022 Houdashell ..... B44D 3/00
2006/0166592 A1 7/2006 Nielsen et al.
2007/0190893 A1 8/2007 Nakashima
2016/0075173 A1 * 3/2016 Hutton ..... B44D 3/02 206/1.7
2016/0310865 A1 10/2016 Won

* cited by examiner

*Primary Examiner* — Rafael A Ortiz
(74) *Attorney, Agent, or Firm* — Rumit Ranjit Kanakia

(57) ABSTRACT

The present invention relates to the technical field of toys for children, and in particular to a novel toy for painting eggs. The novel toy includes a shell, a battery box, an electric motor, a transmission rod, a rotary transmission rod, a transmission rod fixing device, a transmission cap and a toy egg, where the battery box is fixedly arranged on the shell, the battery box corresponds to the electric motor, the electric motor is fixedly connected to the transmission rod, and the transmission rod is movably connected to the rotary transmission rod; the electric motor drives the rotary transmission rod to operate by means of the transmission rod; the toy egg is arranged above the shell; and the transmission rod fixing device fixes the rotary transmission rod to the shell by means of the transmission cap.

3 Claims, 4 Drawing Sheets

TOY FOR PAINTING EGGS

TECHNICAL FIELD

The present invention relates to the technical field of toys for children, and in particular to a novel toy for painting eggs.

BACKGROUND ART

Children paint their eggs with satisfactory colors through crayons, which is conducive to development of their imagination and thinking.

SUMMARY

An objective of the present invention is to provide a novel toy for painting eggs. The toy has a simple structure and is entertaining.

The present invention provides a novel toy for painting eggs. The novel toy for painting eggs includes a main shell, a battery box, an electric motor, a transmission rod, a rotary transmission rod, a transmission rod fixing device, a transmission cap and a toy egg.

The battery box is fixedly arranged on the main shell, the battery box corresponds to the electric motor, the electric motor is fixedly connected to the transmission rod, and the transmission rod is movably connected to the rotary transmission rod. The electric motor drives the rotary transmission rod to operate by means of the transmission rod.

The toy egg is arranged above the main shell. The transmission rod fixing device fixes the rotary transmission rod to the main shell by means of the transmission cap.

In a possible embodiment, the novel toy for painting eggs further includes a spherical hoop, a spherical hoop upper layer, a spherical hoop middle layer, a spherical hoop lower layer and a shell fixing hole.

The shell fixing hole is arranged on the main shell and is configured to be fastened to a main shell cover corresponding to the main shell.

The spherical hoop upper layer is fixedly connected to the spherical hoop middle layer, and the spherical hoop middle layer is fixedly connected to the spherical hoop lower layer. The spherical hoop is movably connected to the spherical hoop lower layer.

The rotary transmission rod (11) drives the spherical hoop lower layer (5) to conduct fixed connection by means of the transmission cap (13), a bottom of the spherical hoop lower layer (5) is provided with a recess, and the recess corresponds to the transmission cap (13), so as to facilitate fixed connection.

In a possible embodiment, the spherical hoop lower layer is provided with two mounting holes, the spherical hoop is provided with two protrusions, and the two protrusions match the two mounting holes.

In a possible embodiment, the novel toy for painting eggs further includes a drawer, where the drawer is arranged on the main shell, and the drawer is configured to contain crayons.

Compared with the prior art, the present invention has the beneficial effects that the toy for painting eggs in the present application enables the toy egg to be painted more evenly with paint during egg painting, and a playing method is novel and more popular with children.

BRIEF DESCRIPTION OF THE DRAWINGS

In FIGS. 1-5: 1 spherical hoop, 2 toy egg, 3 spherical hoop upper layer, 4 spherical hoop middle layer, 5 spherical hoop lower layer, 6 transmission rod fixing device, 7 battery box, 8 main shell, 9 electric motor, 10 transmission rod, 11 rotary transmission rod, 12 shell fixing hole, 13 transmission cap, and 14 drawer.

DETAILED DESCRIPTION OF THE EMBODIMENTS

Figure 1:
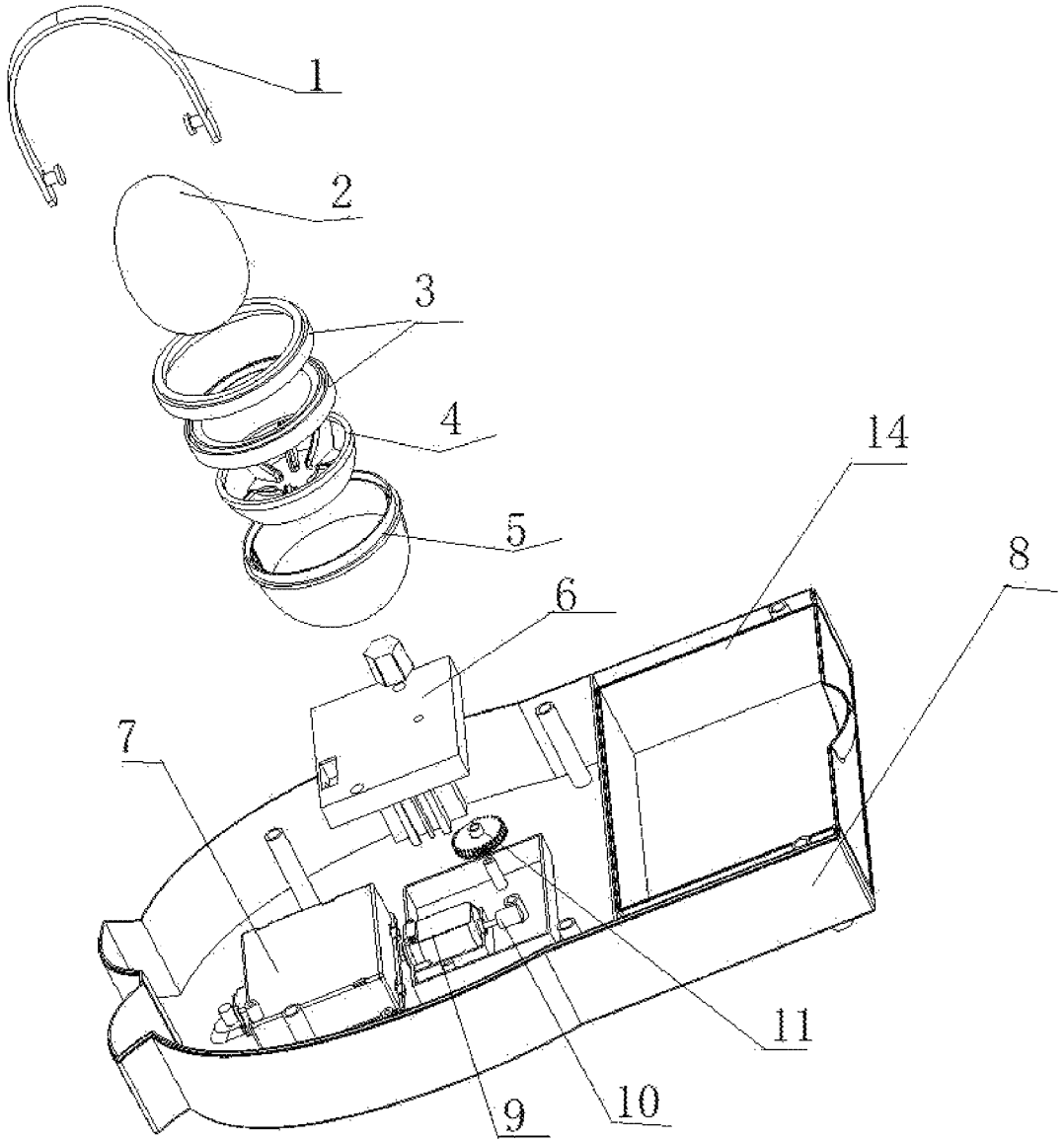
FIG. 1 is a structural schematic diagram of a toy for painting eggs.
Figure 2:
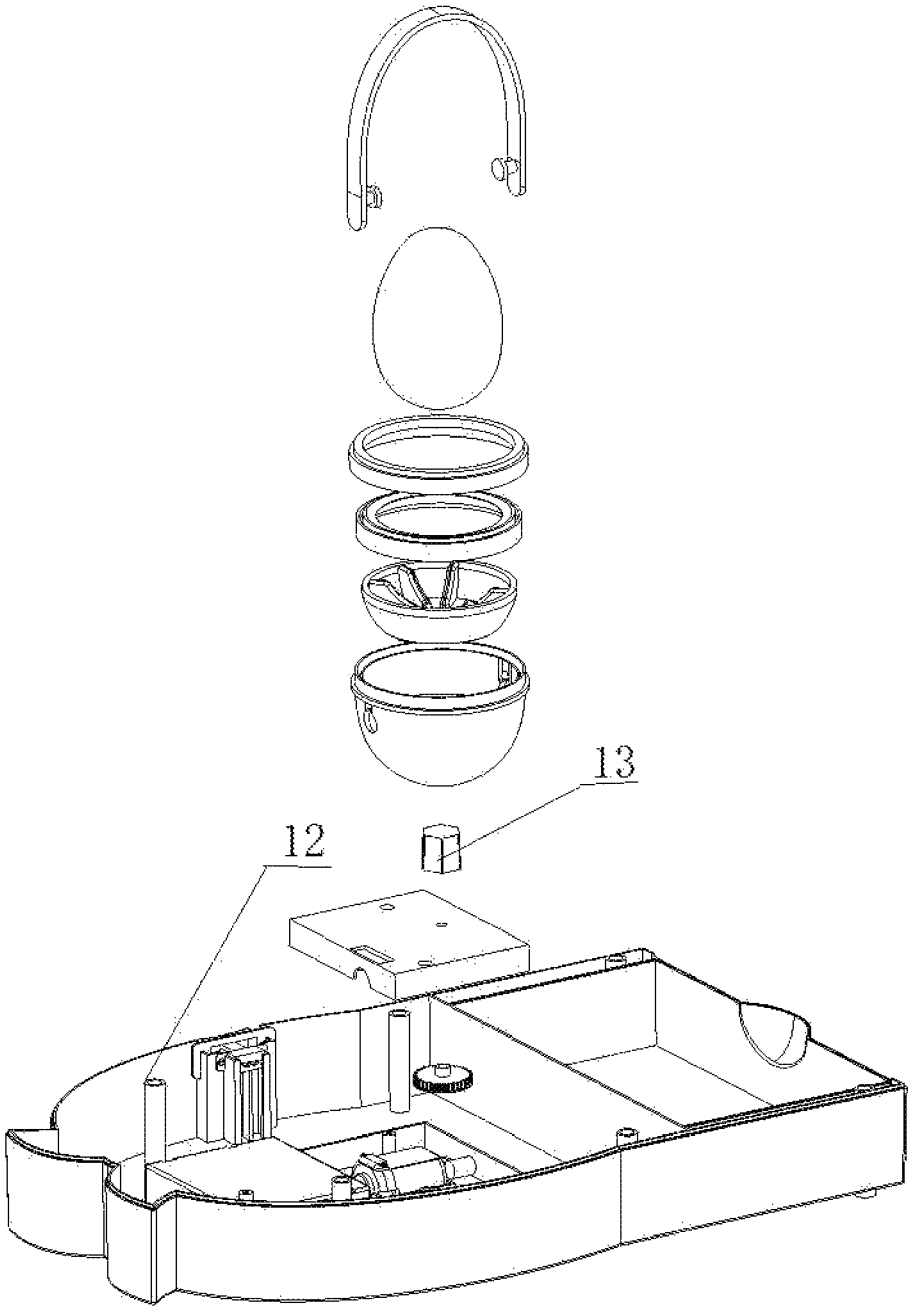
FIG. 2 is another structural schematic diagram of the toy for painting eggs.
Figure 3:
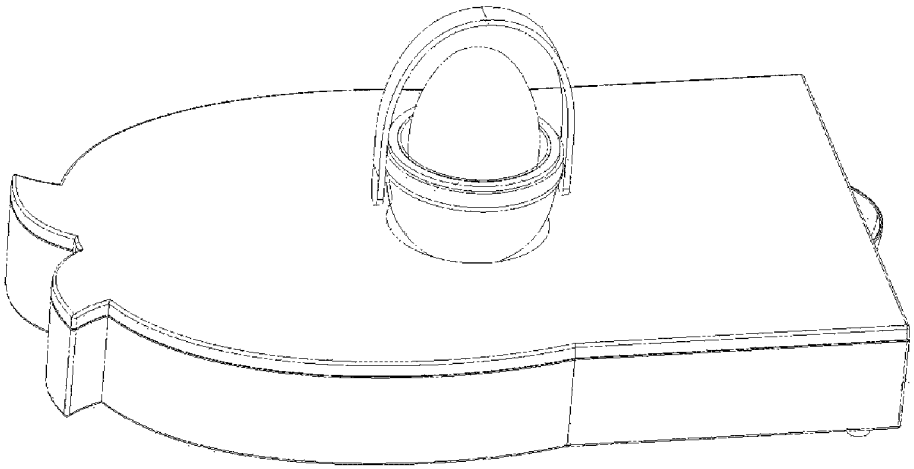
FIG. 3 is a schematic diagram of an overall structure of the toy for painting eggs.
Figure 4:
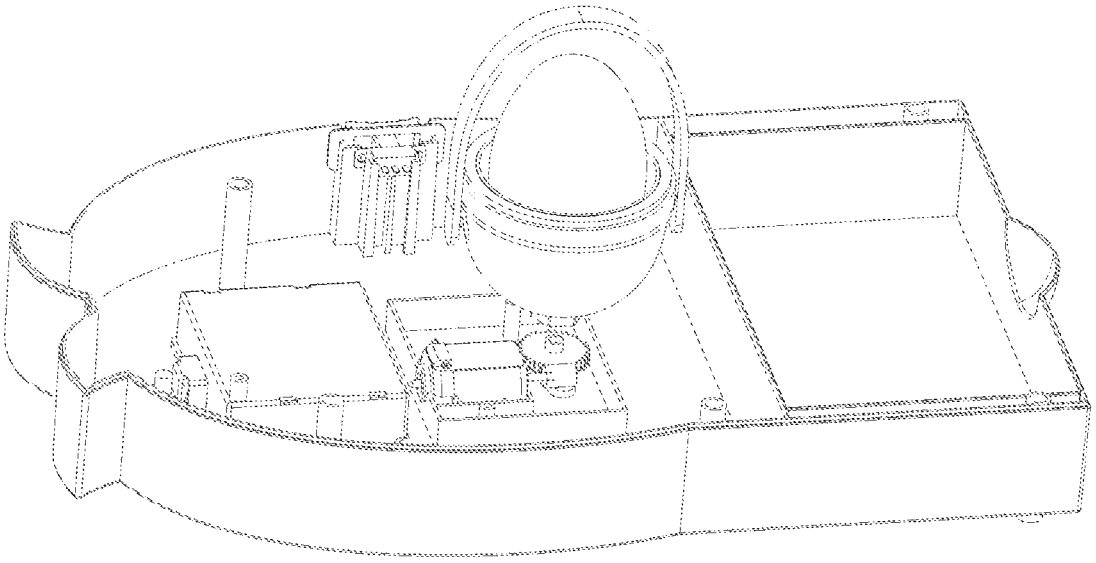
FIG. 4 is an overall schematic diagram of an internal structure of the toy for painting eggs.
Figure 5:
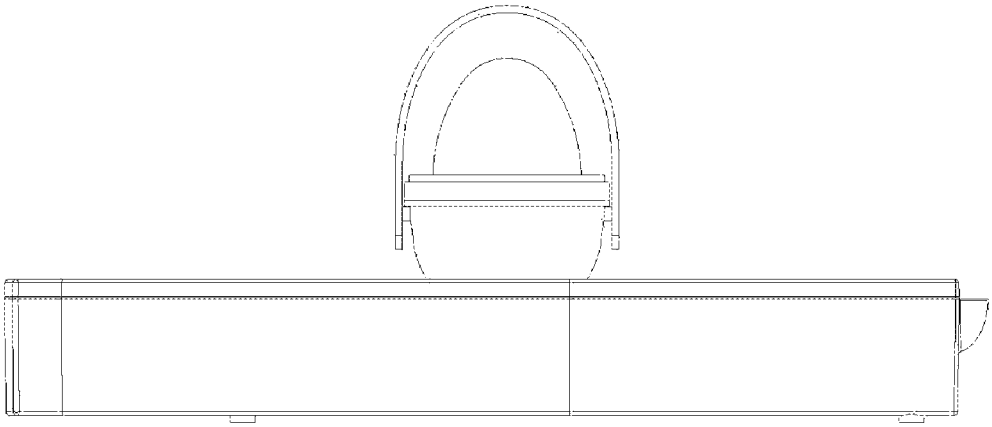
FIG. 5 is a schematic diagram of a side view of the overall structure of the toy for painting eggs.

The technical solutions of embodiments of the present invention are described below clearly and comprehensively with reference to accompanying drawings in the embodiments of the present invention. It is obvious that the embodiments described are merely a part of embodiments of the present invention, instead of all embodiments. On the basis of the embodiments of the present invention, all other embodiments obtained by those of ordinary skill in the art without making inventive efforts fall within the scope of protection of the present invention.

Disclosed is a novel toy for painting eggs. The novel toy for painting eggs includes a main shell 8, a battery box 7, an electric motor 9, a transmission rod 10, a rotary transmission rod 11, a transmission rod fixing device 6, a transmission cap 13 and a toy egg 2.

The battery box 7 is fixedly arranged on the main shell 8, the battery box 7 corresponds to the electric motor 9, the electric motor 9 is fixedly connected to the transmission rod 10, and the transmission rod 10 is movably connected to the rotary transmission rod 11. The electric motor 9 drives the rotary transmission rod 11 to operate by means of the transmission rod 10.

The toy egg 2 is arranged above the main shell 8. The transmission rod fixing device 6 fixes the rotary transmission rod 11 to the main shell 8 by means of the transmission cap 13.

In an example, the novel toy for painting eggs further includes a spherical hoop 1, a spherical hoop upper layer 3, a spherical hoop middle layer 4, a spherical hoop lower layer 5 and a shell fixing hole 12.

The shell fixing hole 12 is arranged on the main shell 8 and is configured to be fastened to a shell cover corresponding to the main shell 8.

The spherical hoop upper layer 3 is fixedly connected to the spherical hoop middle layer 4, and the spherical hoop middle layer 4 is fixedly connected to the spherical hoop lower layer 5. The spherical hoop 1 is movably connected to the spherical hoop lower layer 5.

The rotary transmission rod (11) drives the spherical hoop lower layer (5) to conduct fixed connection by means of the transmission cap (13), a bottom of the spherical hoop lower layer (5) is provided with a recess, and the recess corresponds to the transmission cap (13), so as to facilitate fixed connection.

In an example, the spherical hoop lower layer 5 is provided with two mounting holes, the spherical hoop 1 is provided with two protrusions, and the two protrusions match the two mounting holes.

The present invention can enable an egg to be painted more evenly with paint during painting, and a playing method is novel and more popular with children. Moreover, when children play with the toy for painting eggs, clothes of children are prevented from being stained, thus reducing burden of parents.

For those skilled in the art, it is apparent that the present invention is not limited to the details of the above-mentioned exemplary embodiments, and the present invention can be implemented in other specific forms without departing from the spirit or basic features of the present invention. Therefore, no matter from which point of view, the embodiments should all be regarded as exemplary and non-limiting. The scope of the present invention is defined by the appended claims rather than the above-mentioned description, and therefore it is intended that all changes which fall within the meaning and scope of equivalency of the claims are embraced in the present invention. Any reference numeral in the claims should not be construed as limiting the related claims.

What is claimed is:

1. A novel toy for painting eggs, comprising a shell (8), a battery box (7), an electric motor (9), a transmission rod (10), a rotary transmission rod (11), a transmission rod fixing device (6), a transmission cap (13), a spherical hoop (1), a toy egg (2), a spherical hoop upper layer (3), a spherical hoop middle layer (4), a spherical hoop lower layer (5) and a shell fixing hole (12), wherein the battery box (7) is fixedly arranged on the main shell (8), the battery box (7) corresponds to the electric motor (9), the electric motor (9) is fixedly connected to the transmission rod (10), and the transmission rod (10) is movably connected to the rotary transmission rod (11); the electric motor (9) drives the rotary transmission rod (11) to operate by means of the transmission rod (10);

the toy egg (2) is arranged above the main shell (8); and the transmission rod fixing device (6) fixes the rotary transmission rod (11) to the main shell (8) by means of the transmission cap (13);

the shell fixing hole (12) is arranged on the main shell (8) and is configured to be fastened to a main shell cover corresponding to the main shell (8);

the spherical hoop upper layer (3) is fixedly connected to the spherical hoop middle layer (4), and the spherical hoop middle layer (4) is fixedly connected to the spherical hoop lower layer (5); the spherical hoop (1) is movably connected to the spherical hoop lower layer (5); and the rotary transmission rod (11) drives the spherical hoop lower layer (5) to conduct fixed connection by means of the transmission cap (13), a bottom of the spherical hoop lower layer (5) is provided with a recess, and the recess corresponds to the transmission cap (13), so as to facilitate fixed connection.

2. The novel toy for painting eggs according to claim 1, wherein the spherical hoop lower layer (5) is provided with two mounting holes, the spherical hoop (1) is provided with two protrusions, and the two protrusions match the two mounting holes.

3. The novel toy for painting eggs according to claim 1, further comprising a drawer (14), wherein the drawer (14) is arranged on the main shell (8), and the drawer (14) is configured to contain crayons.

* * * * *